US007367692B2

(12) United States Patent
Maxik

(10) Patent No.: US 7,367,692 B2
(45) Date of Patent: May 6, 2008

(54) LIGHT BULB HAVING SURFACES FOR REFLECTING LIGHT PRODUCED BY ELECTRONIC LIGHT GENERATING SOURCES

(75) Inventor: Fredric S. Maxik, Indialantic, FL (US)

(73) Assignee: Lighting Science Group Corporation, Dallas, TX (US)

( * ) Notice: Subject to any disclaimer, the term of this patent is extended or adjusted under 35 U.S.C. 154(b) by 0 days.

(21) Appl. No.: 10/915,138

(22) Filed: Aug. 9, 2004

(65) Prior Publication Data

US 2005/0243552 A1 Nov. 3, 2005

Related U.S. Application Data

(60) Provisional application No. 60/567,226, filed on Apr. 30, 2004.

(51) Int. Cl.
*F21V 7/00* (2006.01)

(52) U.S. Cl. ..... 362/307; 362/800

(58) Field of Classification Search ..... 362/800, 362/307

See application file for complete search history.

(56) References Cited

U.S. PATENT DOCUMENTS 2,981,827 A * 4/1961 Orsatti et al. ..... 362/293

(Continued)

FOREIGN PATENT DOCUMENTS

| | | |
|---|---|---|
| DE | 101 05 622 A1 | 8/2002 |
| EP | 0 441 965 A1 | 8/1991 |
| EP | 0 617 092 A2 | 3/1994 |

(Continued)

OTHER PUBLICATIONS http://www.m-w.com/dictionary/rectifier.*

(Continued)

*Primary Examiner*—Ali Alavi
*Assistant Examiner*—William J Carter
(74) *Attorney, Agent, or Firm*—Haynes and Boone, LLP

(57) ABSTRACT

The present light bulb uses electronic light generating sources and serves as a replacement for incandescent lamps or other lamps or so-called "light bulbs." The light bulb is comprised of a plurality of individual light sources, such as light emitting diodes (LED's), capable of emitting white light or blue light or light of any other desired color. These light emitting elements are enclosed in an outer bulb housing that may include an optical tuning element and provided with the proper base for connection to a power source, e.g. a socket. The light bulb is characterized by a housing having a round top and a somewhat funnel-shaped side wall connected to the base. The side wall is constructed with the desired angle of taper in order to obtain the desired angle of dispersion of the light. The interior of the tapered portion is provided with a mirrored surface so as to reflect light in the interior of the bulb and thereby obtain a wide angle of dispersion. An inner peripheral row of LED's or other light sources is also provided so that additional backlight is reflected back into the interior of the bulb housing, reflect off of the mirrored surface and, thereafter, allowed to escape through the round top with a wide angle of dispersion. In addition, the optical tuning element may include reflective portions, opaque portions, and transparent portions to further provide functionality and means for adjusting the dispersion of the light emitted from the light bulb.

42 Claims, 5 Drawing Sheets

U.S. PATENT DOCUMENTS 4,136,378 A * 1/1979 Chevali ..... 362/247
4,211,955 A 7/1980 Ray
4,243,934 A * 1/1981 Brasfield ..... 324/72
4,423,473 A 12/1983 Kirkley
4,455,562 A 6/1984 Dolan et al.
D302,863 S 8/1989 Krol
D325,994 S 5/1992 Hume et al.
5,136,483 A * 8/1992 Schoniger et al. ..... 362/800
5,162,696 A 11/1992 Goodrich
5,175,528 A 12/1992 Choi et al.
D336,963 S 6/1993 Levin et al.
5,313,187 A 5/1994 Choi et al.
5,358,880 A 10/1994 Lebby
D355,495 S 2/1995 Matsumura et al.
5,439,941 A 8/1995 Butler et al.
5,561,346 A * 10/1996 Byrne ..... 362/252
5,585,783 A 12/1996 Hall
5,707,132 A 1/1998 Ooki et al.
5,749,646 A 5/1998 Brittell
D395,092 S 6/1998 Vakil
5,782,553 A 7/1998 McDermott
5,877,863 A * 3/1999 Ross et al. ..... 356/445
5,929,788 A * 7/1999 Vukosic ..... 362/800
D414,282 S 9/1999 Kato et al.
6,016,038 A 1/2000 Mueller et al.
D426,653 S 6/2000 Ho
D427,335 S 6/2000 Noll
D433,166 S 10/2000 Noll
6,150,771 A 11/2000 Perry
6,150,774 A 11/2000 Mueller
D435,577 S 12/2000 McBride
6,166,496 A 12/2000 Lys
6,184,628 B1 2/2001 Ruthenberg
6,211,626 B1 4/2001 Lys
6,220,722 B1 * 4/2001 Begemann ..... 362/800
6,227,679 B1 5/2001 Zhang
6,285,119 B1 9/2001 Sundhar
6,286,969 B1 * 9/2001 Kurokawa et al. ..... 362/236
6,293,684 B1 9/2001 Riblett
6,345,903 B1 2/2002 Koike
6,350,041 B1 2/2002 Tarsa et al.
6,369,781 B2 4/2002 Hashimoto et al.
6,371,636 B1 4/2002 Wesson
6,489,937 B1 12/2002 Ruvinsky
D469,890 S 2/2003 Bobel
D470,606 S 2/2003 Bobel
D470,608 S 2/2003 Bobel
D470,610 S 2/2003 Bobel
6,523,978 B1 2/2003 Huang
6,547,421 B2 * 4/2003 Sugano ..... 362/268
6,548,967 B1 4/2003 Dowling
6,580,228 B1 6/2003 Chen et al.
6,600,274 B1 7/2003 Hughes
6,608,453 B2 8/2003 Morgan
6,621,222 B1 9/2003 Hong
D482,143 S 11/2003 Buschmann et al.
6,659,632 B2 12/2003 Chen
6,662,489 B2 12/2003 Spiro et al.
6,674,096 B2 1/2004 Sommers
6,683,419 B2 1/2004 Kriparos
6,697,130 B2 2/2004 Weindorf
D487,940 S 3/2004 Buschmann et al.
6,707,247 B2 3/2004 Murano
6,709,126 B1 3/2004 Leen
6,709,132 B2 3/2004 Ishibashi
6,724,156 B2 4/2004 Fregoso
D490,919 S 6/2004 Wiesmeth
D491,301 S 6/2004 Chen
D493,007 S 7/2004 Rugendyke et al.
6,767,111 B1 7/2004 Lai
D494,687 S 8/2004 Matsui et al.
D497,439 S 10/2004 Shaw et al.
D498,310 S 11/2004 Gagnon et al.
6,822,397 B2 11/2004 Kawasaki et al.
D500,872 S 1/2005 Foo
D501,055 S 1/2005 Packard
6,840,003 B2 1/2005 Moore
6,883,938 B1 * 4/2005 Kohara et al. ..... 362/296
D505,738 S 5/2005 Buschmann et al.
6,900,781 B1 5/2005 Mori et al.
D508,575 S 8/2005 Buschmann et al.
6,942,360 B2 9/2005 Chou et al.
6,953,265 B2 * 10/2005 Suehiro et al. ..... 362/800
D514,237 S 1/2006 Buschmann et al.
6,982,518 B2 1/2006 Chou et al.
D516,229 S 2/2006 Tang
D528,227 S 9/2006 Chou et al.
D529,635 S 10/2006 Johnson
D532,124 S 11/2006 Iwase et al.
D535,038 S 1/2007 Egawa et al.
7,178,941 B2 2/2007 Roberge et al.
2001/0024112 A1 9/2001 Jacobs et al.
2001/0055353 A1 12/2001 Rybicki et al.
2002/0187570 A1 12/2002 Fukasawa
2003/0031015 A1 2/2003 Ishibashi
2003/0072145 A1 4/2003 Nolan et al.
2003/0090910 A1 5/2003 Chen
2003/0117803 A1 6/2003 Chen
2004/0026683 A1 2/2004 Yamada et al.
2004/0037080 A1 2/2004 Luk et al.
2004/0052076 A1 3/2004 Mueller et al.
2004/0189185 A1 9/2004 Yotsuya
2005/0007304 A1 1/2005 Gallagher et al.
2005/0099108 A1 5/2005 Hofmann et al.
2005/0174769 A1 8/2005 Yong et al.
2005/0248277 A1 11/2005 Van Bruggen et al.
2006/0002110 A1 1/2006 Dowling et al.

FOREIGN PATENT DOCUMENTS

EP 0 939 429 A1 9/1999
FR 2 586 844 3/1987
GB 2 345 954 A 7/2000
GB 2 366 610 A 3/2002
JP 10-305453 11/1998
JP 2000-21209 1/2000
JP 2001 243807 9/2001
JP 2001 325809 11/2001
WO WO 03/017320 A1 2/2003
WO WO 03/034458 A2 4/2003
WO WO 03/059013 A1 7/2003
WO WO 2004/003869 1/2004

OTHER PUBLICATIONS http://wordnet.princeton.edu/perl/webwn?s=housing.*

Fredric S. Maxik, U.S. Appl. No. 60/554,469 filed Mar. 18, 2004 for "Lightbulb Using Electronically Activated Light Emitting Elements and Method of Making Same".

Fredric S. Maxik, U.S. Appl. No. 60/565,268 filed Apr. 23, 2004 for "Electronic Light Generating Element Lightbulb".

Fredric S. Maxik, U.S. Appl. No. 60/567,082 filed Apr. 30, 2004 for "Wide Angle Light Dispersion Electronically Activated Lightbulb and Method of Making Same".

Fredric S. Maxik, U.S. Appl. No. 60/567,226 filed Apr. 30, 2004 for "Lightbulb Using Electronic Light Generating Sources".

Fredric S. Maxik and Catherina G.M. Friderici, U.S. Appl. No. 29/224,334 filed Feb. 28, 2005 for "Flashlight".

Fredric S. Maxik and Catherina G.M. Friderici, U.S. Appl. No. 29/224,333 filed Feb. 28, 2005 for "Floodlight".

Fredric S. Maxik, U.S. Appl. No. 10/915,137 filed Aug. 9, 2004 for "System and Method for Providing Multi-Functional Lighting Using High-Efficiency Lighting Elements in an Environment".

Fredric S. Maxik, U.S. Appl. No. 10/915,278 filed Aug. 9, 2004 for "Lighting Element Using Electronically Activated Light Emitting Elements and Method of Making Same".
Fredric S. Maxik, U.S. Appl. No. 10/915,301 filed Aug. 9, 2004 for "Light Bulb Having Wide Angle Light Dispersion and Method of Making Same".
Fredric S. Maxik, U.S. Appl. No. 10/915,531 filed Aug. 9, 2004 for "Electronic Light Generating Element Light Bulb".
Fredric S. Maxik, U.S. Appl. No. 29/214,892 filed Oct. 8, 2004 for "LED Light Bulb".
Fredric S. Maxik, U.S. Appl. No. 29/214,893 filed Oct. 8, 2004 for "LED Light Bulb".
PCT Search Report (Forms PCT/ISA/220 and 210) and PCT Written Opinion (Form PCT/ISA/237) mailed by the European Patent Office on Aug. 24, 2005 in PCT Application No. PCT/US2005/015029, 13 pages.
Fredric S. Maxik and Addy S. Widjaja, U.S. Appl. No. 29/235,139 filed Jul. 27, 2005 for "LED Light Bulb".
Fredric S. Maxik and Addy S. Widjaja, U.S. Appl. No. 29/235,140 filed Jul. 27, 2005 for "LED Light Bulb".
Fredric S. Maxik, U.S. Appl. No. 29/235,514 filed Aug. 2, 2005 for "LED Light Bulb".
Fredric S. Maxik, U.S. Appl. No. 29/254,208 filed Feb. 17, 2006 for "LED Light Bulb".
Fredric S. Maxik, Catherina G.M. Friderici, and Wei Sun, U.S. Appl. No. 29/254,209 filed Feb. 17, 2006 for "LED Light Bulb".
Fredric S. Maxik and Addy S. Widjaja, U.S. Appl. No. 29/254,210 filed Feb. 17, 2006 for "LED Light Bulb".
PCT International Preliminary Report on Patentability (Forms PCT/IB/326, 373 and 237) mailed by the World Intellectual Property Organization on Nov. 9, 2006 in PCT Application No. PCT/US2005/015029, 7 pages.
Fredric S. Maxik, U.S. Appl. No. 29/243,097 filed Nov. 18, 2005 for "LED Light Bulb".

* cited by examiner

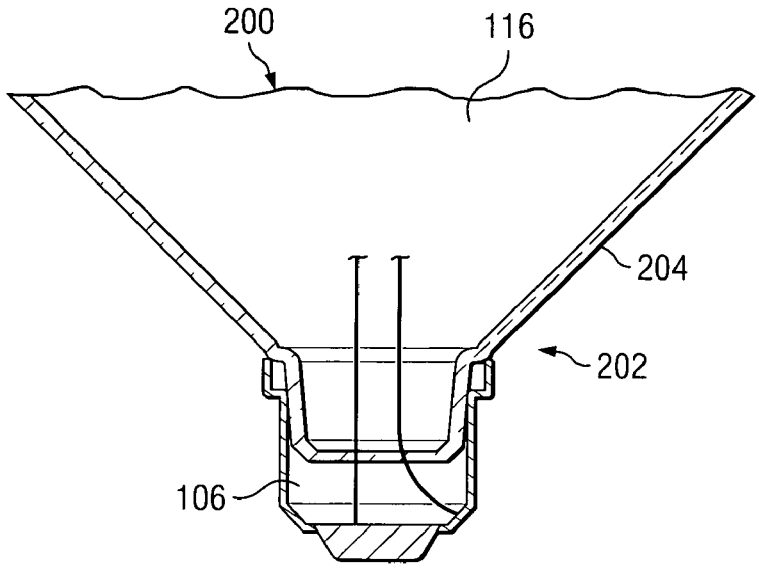
*Fig. 4*
*Fig. 8*
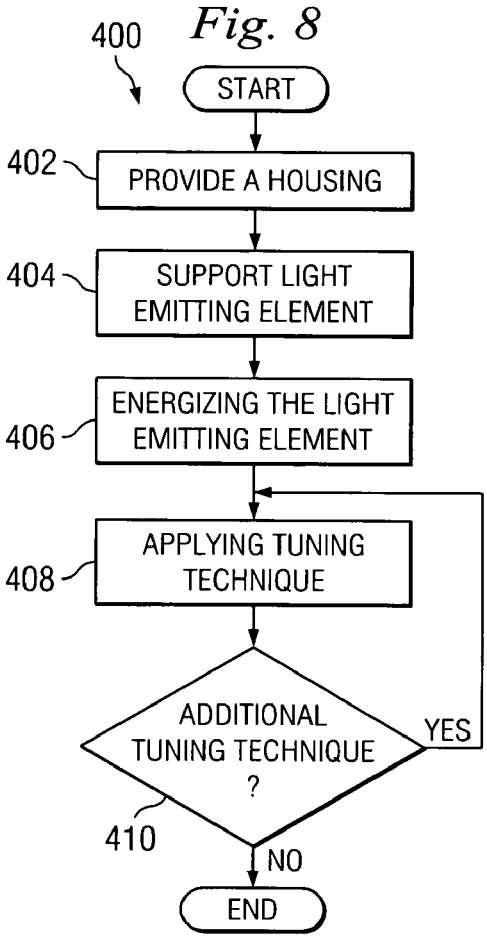
*Fig. 9*
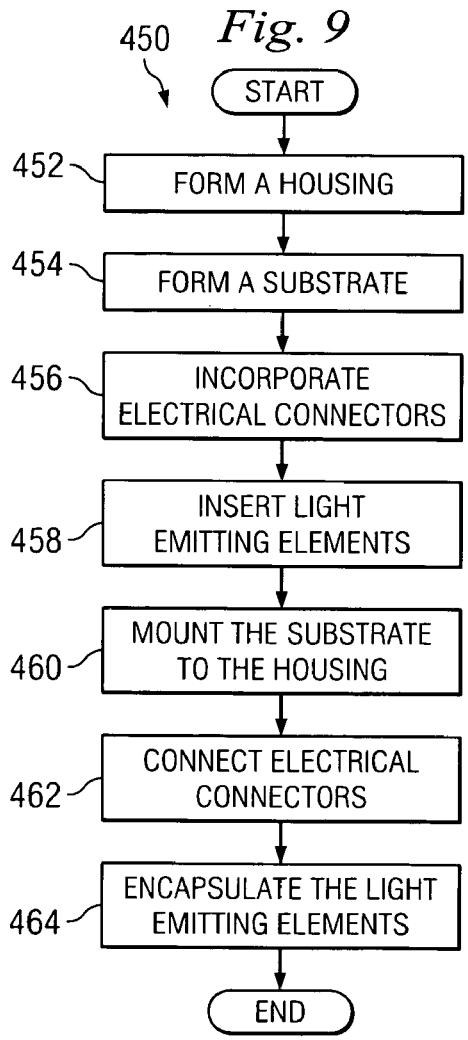

LIGHT BULB HAVING SURFACES FOR REFLECTING LIGHT PRODUCED BY ELECTRONIC LIGHT GENERATING SOURCES

CROSS REFERENCE TO RELATED APPLICATIONS

This application is based on U.S. Provisional Application No. 60/567,226 entitled Lightbulb Using Electronic Light Generating Sources filed on 30 Apr. 2004. The benefit of the filing date of the Provisional Application is claimed for this application. The entire contents of the Provisional Application are incorporated herein by reference.

FIELD OF THE INVENTION

The present invention relates to light bulbs. More specifically, the invention relates to a lighting element for use in light bulbs. The lighting element is comprised of electronic light generating sources, such as light emitting diodes (LED's), which are mounted on a flexible form that is configured to produce increased luminescence and light dispersion provided by backlit LED's.

Problem

Light emitting diodes are constructed with semi-conductor material allowing a conversion of electricity into light. Incandescent lighting, on the other hand, creates light by heating a filament, such as a tungsten filament. Fluorescent lighting creates light by bombarding gaseous mercury with electrons. Although the light generated by bombardment of the mercury is ultraviolet and invisible, the UV light engages with a white phosphor on the inside of the glass enabling the light to be converted to white light so that it is visible to the human eye.

The LED light sources are actually more desirable than other forms of lighting since they provide a more natural color of light and, hence, they are superior for many applications. LED bulbs can be designed to generate light in a variety of colors. In fact, it has been found that LED light sources can be used for area lighting such as desktop work areas, hallways and pathways and the like.

It would be quite advantageous to use LED light bulbs, as opposed to the more conventional incandescent lamps. Unfortunately, LED bulbs do not have a wide degree of light dispersion. Unlike incandescent bulbs, LED's do not generate a substantial amount of heat which oftentimes must be dissipated and can sometime lead to burn injuries. Moreover, conventional incandescent lamps have a limited life compared to electronic forms of lighting and associated with the long life of an electronic light source is the fact that it would not be necessary to constantly change the light source when the bulb burned out. Thus, the LED and other electronic light bulbs provide a rather significant advantage over conventional lamps.

Attempts to improve the dispersion qualities of LED's used in illuminating devices, such as blinkers and warning signals, by using curved reflective surfaces to direct the light produced by the LED's outward in a straight path, which does improve the light paths from the LED's but it doesn't improve the dispersion of the light. Other applications attempt to improve the dispersion from LED's by applying a reflective material is disposed on the individual LED encapsulant surface that is disposed opposite the LED die surface. Again, this arrangement reflects light generally incident to the encapsulant possessing the reflective material and not in a true omni directional fashion.

Another attempt to increase the dispersion of light produced by LED's is to arrange a flexible substrate into a semi-spherical or circular arrangement or shape. This arrangement then provides lighting generally perpendicular to the flexible substrate at any given point, but does not provide omni directional lighting. Other techniques include using concave reflector disposed over LED's which concentrates, instead of dispersing the light emitted from the LED's.

It would therefore be desirable to provide a light bulb with organic or inorganic light sources capable of generating a substantial quantity of light which necessitates the use of many individual light elements and also to provide a wide angle of dispersion of the light generated from that bulb.

Information relevant to attempts to address these problems can be found in U.S. Pat. No. 5,136,483 issued Aug. 4, 1992 to Schöniger et al.; U.S. Pat. No. 6,674,096 issued Jan. 6, 2004 to Sommers; U.S. Pat. No. 5,585,783 issued Dec. 17, 1996 to Hall; and U.S. Pat. No. 5,782,553 issued Jul. 21, 1998 to McDermott. However, each one of these references suffers from one or more of the following disadvantages: lack of functionality and limited light dispersion properties.

Solution

In accordance with the present invention, there is provided an LED light bulb that uses a plurality of electronic light emitting elements, such as conventional light emitting diodes (LED's), and which are all mounted within a base. The LED's are thereupon mounted within a housing which may be formed of a plastic or synthetic resin material as, for example, a suitable polyester resin, e.g. an epoxy type resin. The housing is typically funnel shaped and has a shape somewhat similar to that of a conventional incandescent light bulb.

However, the light bulb described in this form, but without the modification offered by the present invention, would result in about 90 degree dispersion, and this is often insufficient for general lighting purposes. In the light bulb of the present invention, the interior surface of the housing and, particularly, the funnel shaped portion thereof is provided with a reflective surface. In this way, some light which does happen to reflect from the LEDs can remain in the housing and reflect back and forth in the housing until it exits through the substrate and optical opening of the housing. This reflected light would tend to have a wider angle of dispersion since it has been reflected within the housing and would exit at an angle relative to the axis of the housing.

In addition to the foregoing, there is also provided additional LEDs which are located on the interior surface of the lens or cap of the housing. It is also possible to use a plurality of light emitting diodes on the interior of the lens, in addition to those which cause the generation of light on the exterior surface of the lens. This additional row of LEDs would cause light to be generated in the interior of the housing and purposely reflected until it exits through the lens. In this way, the light will reflect at various angles and there will therefore be provided a wide angle of light dispersion.

It is possible to adjust the angle of dispersion of the light by adjusting the angle of taper of the reflector. Moreover, by adjusting the length of the light bulb from the base to the lens and adjusting the angle of taper of the light bulb, it is also possible to increase the amount of reflection and, hence, it is possible to adjust the amount of light dispersion. Thus, one of the advantages of the present invention is the fact that there can be a controlled amount of light dispersion. This was difficult to accomplish with conventional light sources, such as incandescent lamps and fluorescent lamps.

Another one of the unique advantages of the present light bulb is the fact that the circuit board upon which the LEDs are mounted can be located at or adjacent to the lens of the bulb. In this way, the light emitting diodes could be mounted directly to the printed circuit board itself and this combination becomes an integral part of the LED light bulb.

Yet another unique advantage of the present light bulb is the use of an optical tuning element to control the dispersion of the light emitted from the light bulb. Specifically, the optical tuning element be shaped and include reflective portions, opaque portions, and transparent portions to control the reflection and dispersion of the light emitted from the light bulb.

It is understood, however, that the present light bulb could be used with any of a variety of light sources and, particularly, light sources which are electronically activated or generated. As an example, in recent years there have been proposals to produce light sources using various known inorganic materials and, for that matter, some organic materials. Thus, the present light bulb is applicable with each of these light generating elements which are all electronically energized or operated. For purposes of the present application, however, the invention will be described in terms of light emitting diodes as the light generating elements, since they are the preferred form. However, it is to be understood that the invention is not so limited.

This present invention thereby provides a unique and novel LED light bulb constructed so as to provide a wide angle of light dispersion and also a controlled light dispersion. The light bulb includes a plurality of LED's arranged to provide backlighting towards a reflective inside wall of the housing that is then reflected back through the transparent substrate and out an optical opening in a wide dispersion, omni directional pattern. The dispersion of the light is further controlled by an optical tuning element that includes reflective portions, opaque portions, and transparent portions located thereon for further providing light dispersion in an omni directional pattern.

The light bulb thereby fulfills all of the above-identified objects and other objects which will become more fully apparent from the consideration of the forms in which it may be embodied. One of these forms is more fully illustrated in the accompanying drawings and described in the following detailed description of the invention. However, it should be understood that the accompanying drawings and this detailed description are set forth only for purposes of illustrating the general principles of the invention.

BRIEF DESCRIPTION OF THE DRAWINGS

FIG. 4 illustrates a cross-section view of another embodiment of a light bulb housing having a wider angle side wall in accordance with the invention;

FIG. 8 illustrates in block flow diagram form a process for dispersed light from a lighting device; and FIG. 9 illustrates in block flow diagram form a process for manufacturing a light bulb having light generating sources.

DETAILED DESCRIPTION OF THE DRAWINGS

Figure 1:
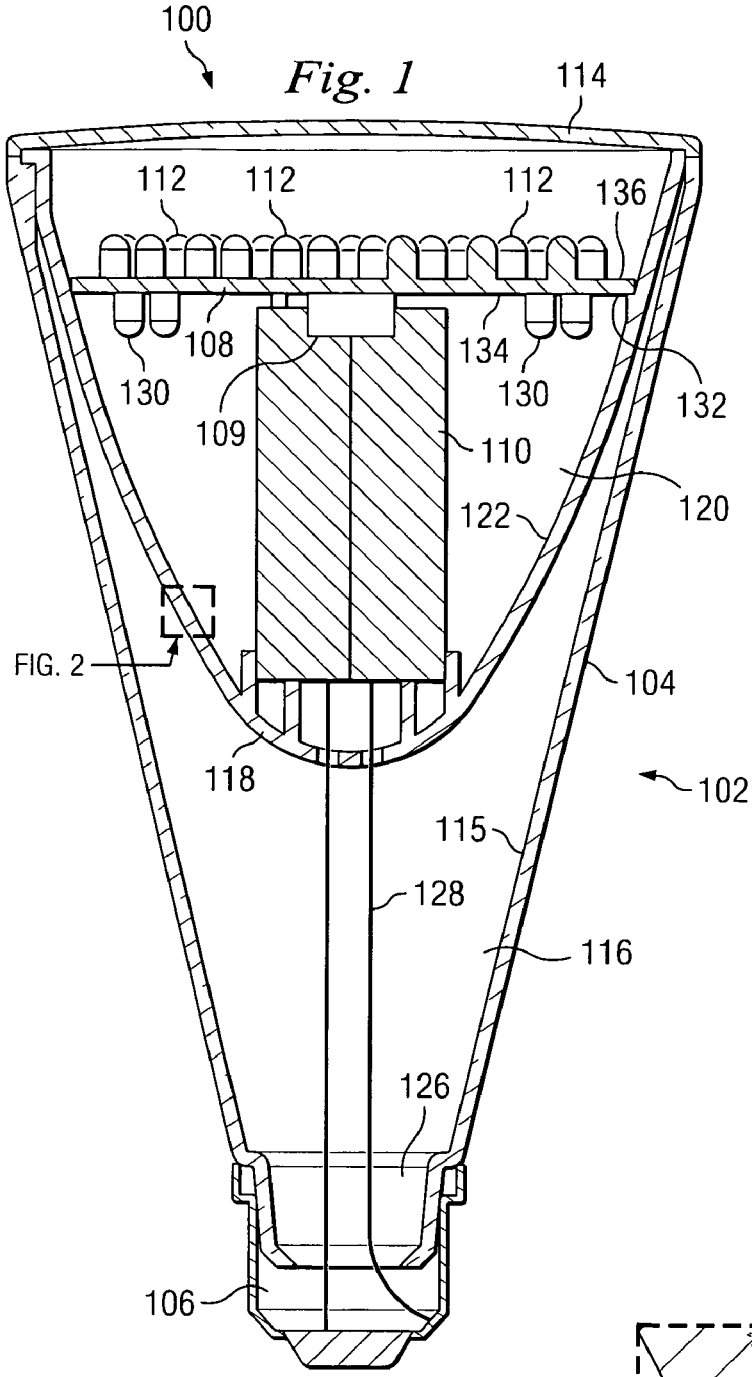
FIG. 1 illustrates a cross-section view of a light bulb having wide angle dispersion material incorporated therein and backlit light emitting elements in accordance with the invention.

Referring now in more detail and by reference to FIG. 1, there is provided an embodiment of a light bulb 100 including a housing 102 having a somewhat conically shaped side wall 104 having an inside surface 115 and which is provided at one end with a base 106 such as a conventional Edison base and which is provided at the other end with a transparent or translucent end cap 114. The base 106 is of the type which is used in a conventional incandescent light socket or other conventional lighting fixture socket, such as used in fluorescent lighting fixtures and the like.

A cavity 116 is defined by the area between the side wall 104 and the transparent or translucent end cap 114. Mounted within the cavity 116 of the housing 102 is a support 110 for supporting a substrate 108 having a plurality of light emitting elements 112. The entire support 110 and light emitting elements 112 are covered partially or fully by the end cap 114. In the embodiment as shown, it should be understood that it is possible to eliminate the end cap 114 and use the substrate 108 as the end cap 114 for the housing 102. The substrate 108 is preferably transparent and may adopt the form of a printed circuit board.

In this embodiment, a semi-hemispherical shaped insert 118 having an inside surface 122 is inserted into the housing 102 to provide a base for the support 110 and the inside surface 122 for reflecting light that enters the cavity 120 of the insert 118. An insert cavity 120 is defined by the area between the insert 118 and the translucent end cap 114.

The substrate 108 has a first surface 136 and a second surface 134 and has an outside peripheral edge 132, generally defined as the circumferential outer perimeter of the substrate 108, which can be connected to a corresponding area of the housing 102, as described further below. The surfaces 136 and 134 are substantially planar, however, they may be formed to a desired shape. Attached to the first surface 136 is the plurality of light emitting elements 112 as described above. These light emitting elements 112 emit light toward the end cap 114. In addition to these light emitting elements 112, are light emitting elements 130 connected to the second surface 134 of the substrate 108. These light emitting elements 130 emit light substantially toward the inside wall 122 of the insert 118. In one aspect of the present light bulb, one or two rows of light emitting elements 130 are located around the outer peripheral edge 132 of the second surface 134. In another aspect of the present light bulb, the light emitting elements 130 may be located elsewhere on the second surface 134 of the substrate 108.

Figure 2:
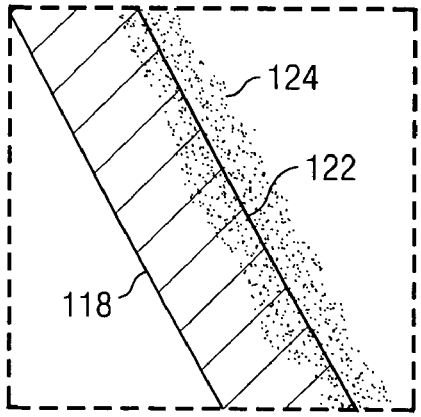
FIG. 2 illustrates an expanded cross-section of a side wall and incorporated crystalline particulate material of a light bulb in accordance with the invention.

Referring to FIG. 2 is an expanded view of a portion of the insert 118 depicting a crystalline particulate material incorporated into the inside surface 122. As can be seen from FIG. 2, the crystalline particulate material 124 is incorporated on the inside surface 122 of the insert 118 and also within the material comprising the insert. In one aspect of the present light bulb, the crystalline particulate material 124 can be mixed and formed with the housing 102, substrate side wall 104, inside surface 115, end cap 114, substrate 108, and support 110. In another aspect of the present light bulb, the crystalline particulate material 124 can be applied with adhesives or the like to the surfaces of the light bulbs after they have been formed or assembled.

Figure 3:
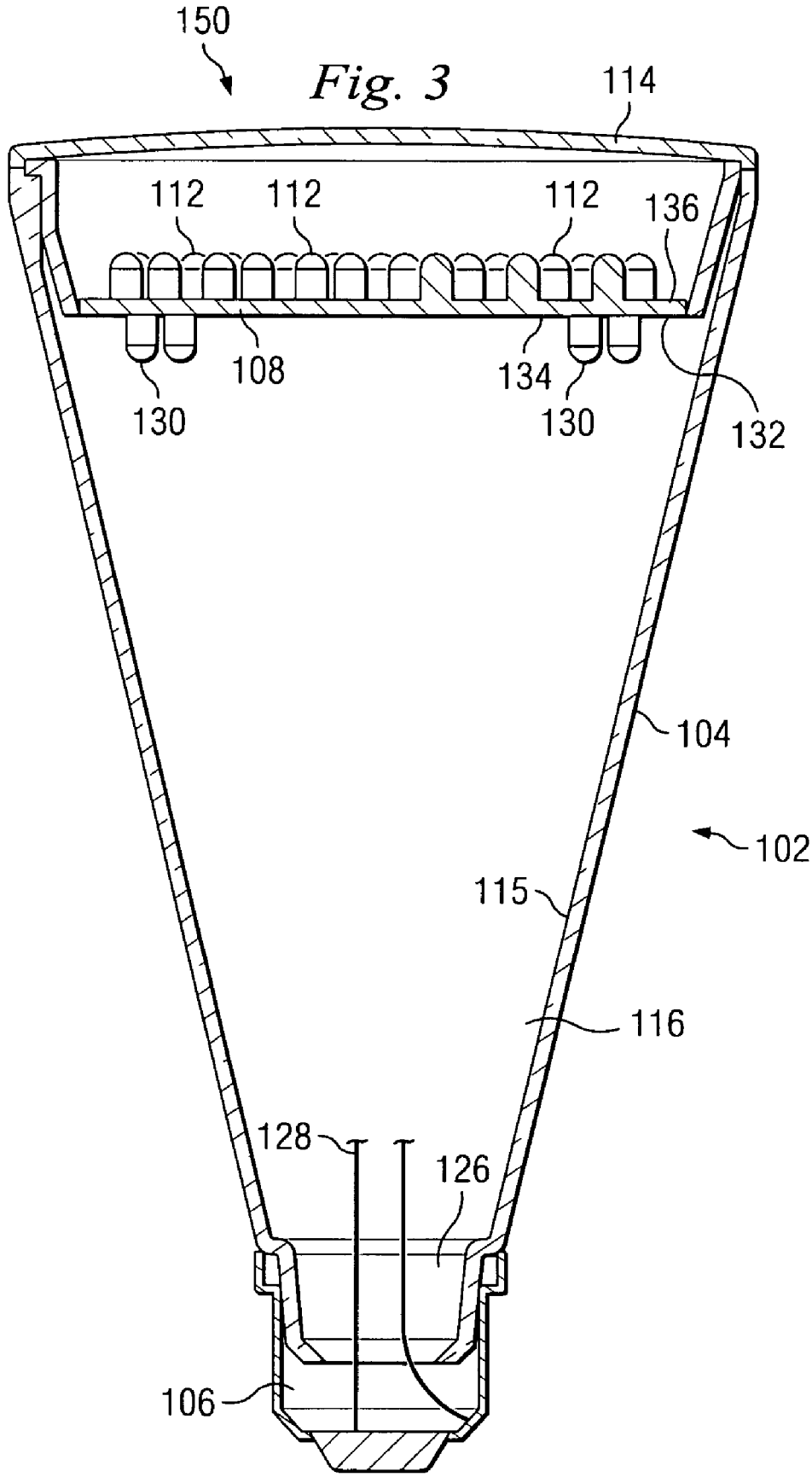
FIG. 3 illustrates a cross-section view of another embodiment of a light bulb having wide angle dispersion material incorporated therein and backlit light emitting elements in accordance with the invention.

Referring to FIG. 3 is another embodiment 150 of a light bulb including similar parts as those previously described in FIG. 1, including a housing 102, a side wall 104 having an inside surface 115, a base 106, a cavity 116, an end cap 114, a plurality of light emitting elements 112, a substrate 108 having a first surface 136 and a second surface 134 and an outer peripheral edge 136. In this embodiment, the substrate 108 may be mounted on and supported at the outer peripheral edge 132 of the housing 102. As can be seen in FIG. 3, light emitting elements 130 are attached to the second surface 134 of the substrate 108 similarly to those depicted in FIG. 1. In addition, the light bulb 150 includes crystalline particulate material 124 incorporated within the side wall 104 of the housing 102.

Referring to FIGS. 1 and 3, it is important to introduce the crystalline particulate material 124 in the side wall 104 including the inside surface 115 and also the end cap 114 of the present light bulb. These light emitting elements 130 effectively backlight or produce light on the cavities 120 and 116 which is then reflected by the crystalline particulate material 124 incorporated in the inside surfaces 122 and 115, which can also be a mirrored surface material. After reflection on the inside surfaces 122 and 115, this light will then exit through the transparent substrate 108 then through the end cap 114. In this way, there is a wide degree of dispersal of light. In addition, the support 110 may also comprise a material including particulate matter. In addition, electrical connectors 128 can be routed through the support 110 or through or along the side walls 104 of the housing 102. Electricity supplied to these electrical connectors 128 can be AC or DC, in the case of AC the necessary circuitry 126 may be located in the base 106 for converting the AC power to DC power. This circuitry 126 may include resistors, rectifying diodes, and Zener diodes. Rectifying diodes convert AC to DC, should the power source to the LED's be AC. Rectifying diodes are not needed when the power supply is DC. In another aspect of the present light bulb, the circuitry may be located elsewhere, such as in the support 110 and be covered with a cover plate (not shown) if desired, which may be transparent in construction.

One of the unique aspects of the present light bulb is that in order to obtain the DC to AC conversion which is desired, a semiconductor rectifier 109 is used. In this aspect, the semiconductor rectifier 109 is located on substrate 108. In this aspect of the present light bulb, it is formed of a semiconductor material, such as silicon which may include a metallic oxide, and does effectively rectify the current in order to achieve an AC current. In this respect, it is believed that the applicant is the first to actually use a semiconductor rectifier in a light emitting element light bulb.

Referring to FIG. 4, another embodiment 200 of the present light bulb 202 is depicted in which the side wall of the housing 204 is located at a more obtuse angle with respect to the base 106. In this way, the amount of reflectivity and light dispersion can then be controlled. This is one of the unique advantages of the present light bulb in that it is now possible to literally control the amount of light dispersion. By increasing the angle of the conical shaped portion of the side wall 204, it is possible to obtain a greater degree of light incidence and angle of reflection. Hence, there will be a greater angle of light dispersion. In fact, there would appear to be a direct correlation between the angle of the side wall 204 with respect to the amount of light dispersion.

Figure 5:
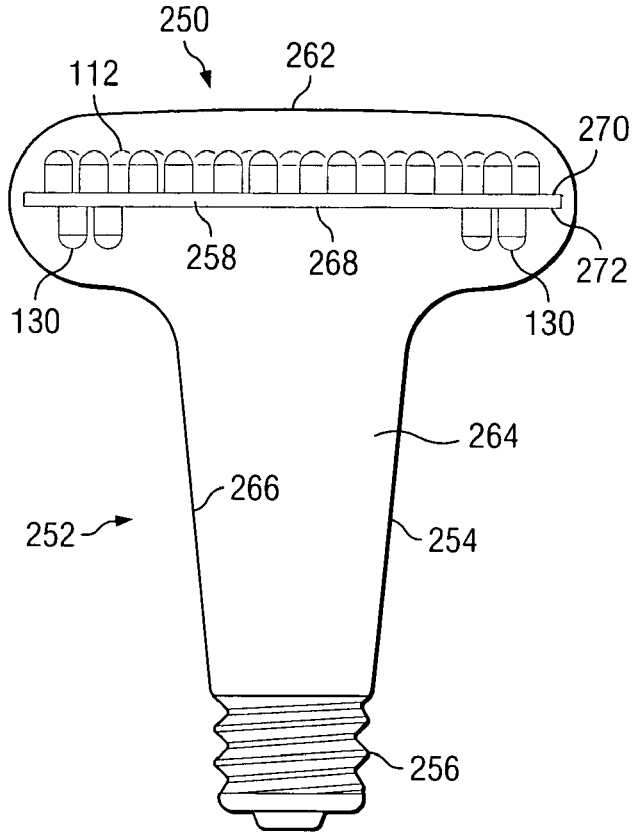
FIG. 5 illustrates a cross-section view of another embodiment of a light bulb having wide angle dispersion material incorporated therein in accordance with the invention.

Referring to FIG. 5, is another embodiment 250 of a light bulb including a housing 252 including a somewhat conically shaped side wall 254 with a flared end having an inside surface 266 and which is provided at one end with a base 256 and a transparent or translucent end cap 262 at the other end. A cavity 264 is defined by the area between the side wall 254 and the end cap 262. Mounted within the cavity 264 of the housing 252 is a substrate 258 having a first surface 270 and a second surface 268 having a plurality of light emitting elements 112 connected to the first surface 270 and a plurality of light emitting elements 130 connected to the second surface 268. Light bulb 250 may further include a support (not shown) located within the cavity 264 for supporting the substrate 258, similar to the support 110 as depicted in FIG. 1. Similarly as described with reference to the other embodiments of the light bulb, it is important to introduce crystalline particulate material 124 in the side wall 254 including the inside surface 266 and also the end cap 262. The light emitted from the light emitting elements 130 will reflect off inside surface 266 and back through the transparent substrate 258 and then through the end cap 262. In addition, if a support is used with this embodiment, the support may also comprise a material including crystalline particulate material 124.

As described with reference to FIGS. 1 and 3, one aspect of the present light bulb provides for the light emitting elements 130 to be arranged a single or double row around the outer peripheral edge 272 of the second surface 268 of the substrate 258. In another aspect, the light emitting elements 130 are arranged elsewhere on the second surface 268 to provide light toward the inside surface 266 to be reflected back through the substrate 258 and then through the end cap 262 to produce a wide angle dispersion of light.

Figure 6:
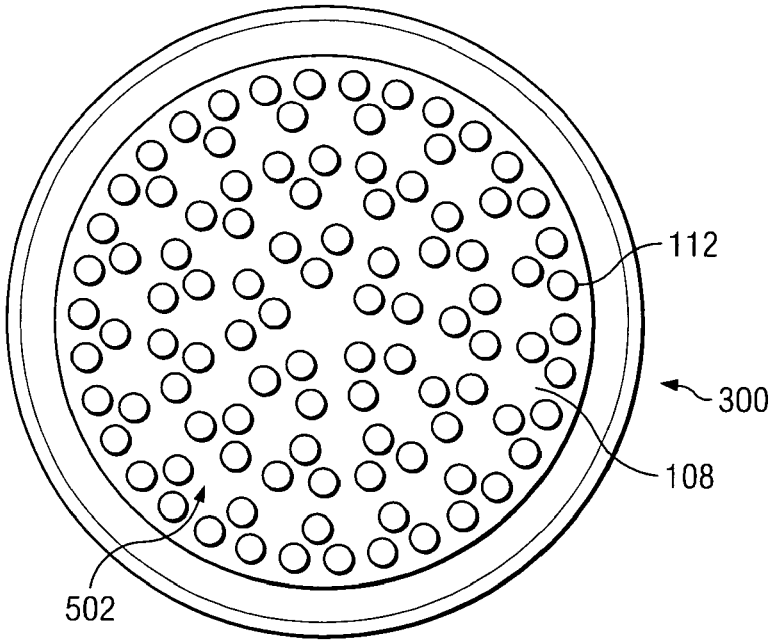
FIG. 6 illustrates a top-section view of a light bulb substrate of the FIGS. 1-4 having wide angle dispersion material incorporated therein in accordance with the invention.

Referring to FIG. 6, is a top view 300 of an end cap 114, which is similar to the cap 262. As can be seen in FIG. 6, a plurality of light emitting elements 112 are grouped together on substrate 108, which is similar to substrate 258. It is noted that in some arrangements of the light emitting elements 112, gaps 502 can be seen in the substrate 108 where light comes through after being reflected within the cavities 116, 120, and 264.

Figure 7:
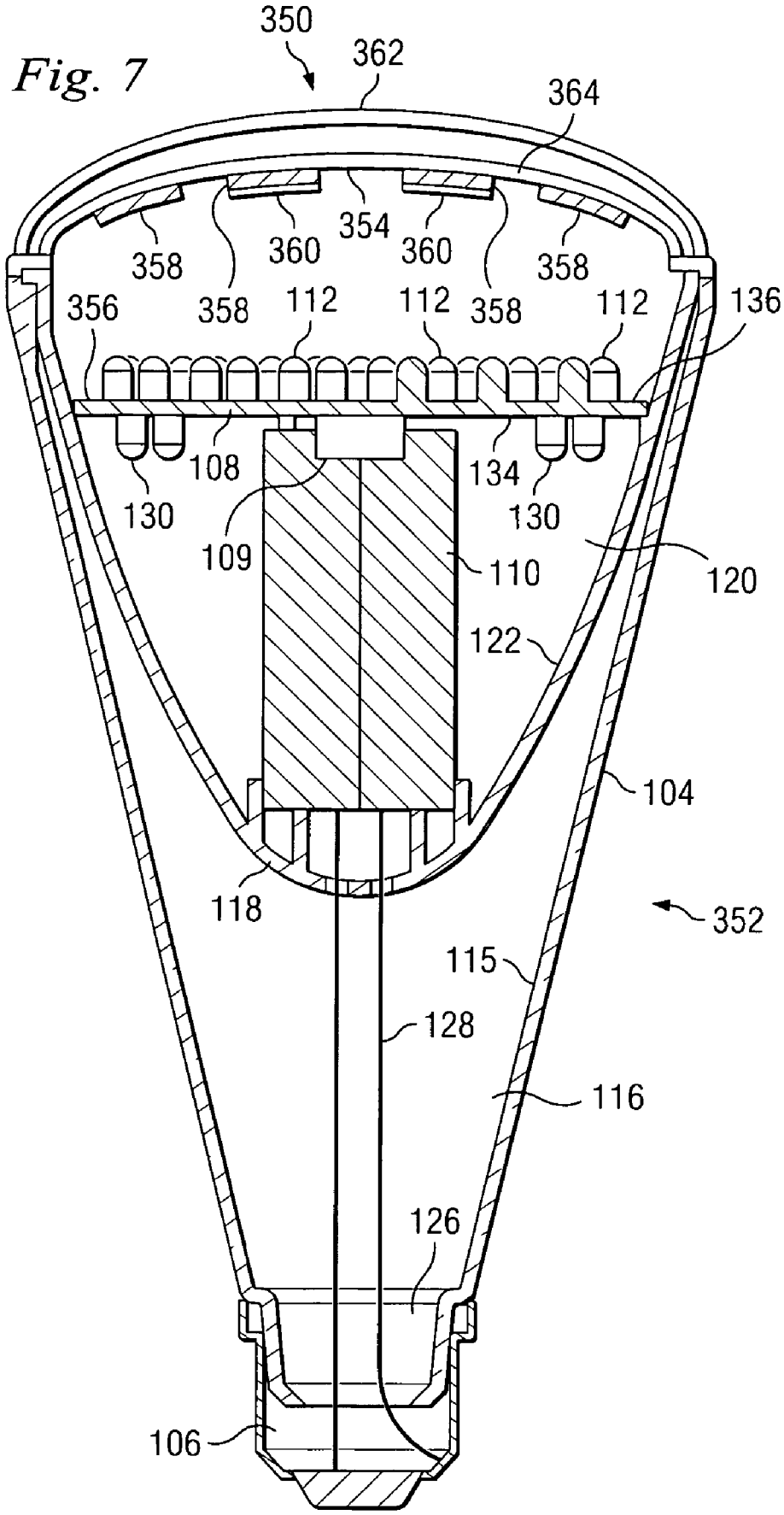
FIG. 7 illustrates a cross-section view of another embodiment of a light bulb including an optical tuning element.

Referring to FIG. 7, is another embodiment 350 of the present light bulb having a housing 352 and many similar elements or parts as described in FIG. 1, including a side wall 104, a base 106, electrical connectors 128, insert cavity 120, support 110, insert 118, substrate 108 having a first surface 136 and a second surface 136, and a plurality of light emitting elements 112 connected to the first surface 136.

In this embodiment, instead of an end cap 114, the light bulb 350 includes an optical tuning element 354 disposed substantially or wholly over the plurality of light emitting elements 112. The optical tuning element 354 preferably includes opaque portions 358 and mirrored portions 360.

In this aspect of the present light bulb, the first surface 136 of the substrate 108 is provided with a mirrored surface 356 or a coating of substantial reflectivity. Disposed over the first surface 136 of the substrate 108 and the light emitting diodes 112 carried thereon is the optical tuning element 354. In one aspect of the present light bulb, the optical tuning element 354 is located under an outer lens 362 if the latter is employed. Moreover, the optical tuning element 354 is provided with opaque areas 358 and transparent areas 364. Thus, light generated from several of the light emitting elements 112 will be reflected off of the opaque portions 358. These opaque portions 358 may also include mirrored portions 360. In this way, light can be reflected off of the mirrored surface 356 on the substrate 108 and also reflected off of the mirrored portions 360. Light which reflects off of the mirrored portions 360 and the mirrored surface 356 will then pass through the transparent areas 364 of the optical tuning element 354 and out through the lens 362 in a wide angle of dispersion.

In this aspect of the present light bulb, it is not necessary to use a crystalline particulate material 124 or mirrored surface on the inside surface 122 of the insert 118. In another aspect of the present light bulb, crystalline particulate material 124 or mirrored surface could also be employed with the light emitting elements 130 if desired for additional light dispersion.

In another aspect of the present light bulb, the arrangement described above in reference to FIG. 7 may be employed without a support 110 or insert 118, similar to light bulb 150.

In one aspect of the present light bulb, the individual parts herein described can be molded or formed individually and then later assembled. In another aspect of the present light bulb, some portions of the light bulbs 100, 150, 200, 250, and 350 can be molded or formed together, while other parts are molded or formed individually and then later assembled. In one aspect of the present light bulbs 100, 150, 200, 250, and 350 the housings 102, 252, 202, and 352; end caps 114, 262, and lens 362; support 110, and substrates 108, 258, and 206 are molded or formed with a mixture of moldable or formable resin including a crystalline particulate material 124.

In one aspect of the present light bulb, end caps 114, 262, and lens may comprise different shapes, forms, thicknesses, patterns, and etchings to provide further dispersion of the light from the light bulbs 100, 150, 200, 250, and 350.

In the formation of the housings 102, 252, 202, and 352; end caps 114, 262, and lens 362; support 110, and substrates 108, 258, and 206, it is important to use materials that are capable of incorporating a particulate matter during the preparation of the materials prior to forming, molding, or shaping. In another aspect of the present light bulb, it is important to use materials that after being formed are capable of incorporating particulate matter with the use of adhesives or other fixture means. Many resins are known and presently used to form these parts, including glass, plastics, polycarbonates, polymers, copolymers and suitable epoxies and acrylics. In another aspect of the present light bulb, a resin, such as acrylonitrile-butadiene-styrene, is effective for forming some or all of these described parts.

In one aspect of the present light bulb, the housing 102, 252, 202, and 352 is preferably formed of a resinous material. However, if desired, it could be formed of glass and fitted to the base 106 with the end caps 114, 262, and lens 362 then secured to the housing 102, 252, 202, and 352.

The light emitting elements 112 and 130 are generally light emitting diodes (LED's), but may be other types of diode lights, such as laser diodes and wide band gap LED's. Generally, these typical LED's are normally constructed using standard AlInGaN or AlInGaP processes and include a LED chip or die mounted to a reflective metal dish or reflector that is generally filled with a transparent or semi-transparent epoxy, thus encapsulating the LED chip. The epoxy or encapsulant serves the purposes of reducing the total internal reflection losses and sealing the LED chip or die. Lensless LED's have the encapsulant removed from the reflective metal dish, thus exposing the diode. The present LED light bulb provides use of both of these types of LED's. The LED's used in the present LED light bulb provide a wide functional coverage according to the specific LED's employed with the LED light bulb.

Any color of LED's can be used with the present LED light bulb, colored LED's such as red (R), blue (B), and green (G) can be use in addition to white (W) with the present LED light bulb to accommodate the desires of the user. For example, mood lighting can be achieved by combining the desired colored LED's together in the LED light bulb. The end desired light product can be achieved by using the RGBW LED's to accomplish the desired lighting. By way of illustration, if a 3,700 Kelvin color is desired, the mix of the LED's would be 50 red, 27 green, and 23 blue to achieve this color. In this aspect of the LED light bulb, a designed housing 102, 252, 202, and 352 incorporating the proper microoptics, such as finishes or thin films, mixes the color to provide the desired end product. The number, arrangement, and color selection of the LED's on the formed substrate 108 and 258 creates a flexible LED light bulb that can meet the desired lighting requirements of a given situation.

The LED's can be color shifted as well to increase the flexibility of the end product LED light bulb. The color can be adjusted as well to add greater flexibility. Generally, any number and color of LED's can be used to provide the desired lighting requirements. By way of example, a department store may desire to have more of a full-spectrum lighting arrangement for its cosmetic counters. In this example, several different LED's will be used to provide a light with a fuller spectrum with optimal color rendering than may be needed for lighting a hallway or other room in a building. In addition to the lighting function provided by the LED light bulb, other functions can be provided by the LED light bulb, either independently or in concert with the lighting function.

The present invention provides exemplary methods for producing a tuned dispersed light from the present light bulb. FIG. 8 illustrates a block flow diagram of an exemplary method 400 in accordance with the present light bulb. In step 402, a housing 102, 202, 252, and 352 is provided generally including a base 106 and 256, however, the base 106 and 256 at this step may or may not be attached to the housing 102, 202, 252, and 352. The housing 102, 202, 252, and 352 is formed using a transparent, semi-transparent, or translucent material and is shaped to a desired shape. In addition, the housing 102, 202, 252, and 352 may be provided in a single piece or separate pieces to be attached together later in the process by adhesives or other fixture means. The base 104 and 256 also generally includes a formed socket a socket piece for inserting into a standard socket, Edison-style or standard electrical socket or connection.

Step 402 also includes providing housings 102, 202, 252, and 352 having optimized shapes and lengths to achieve the desired light dispersion characteristics from the present light bulb. This step includes providing housings 102, 202, 252, and 352 including a side wall 104, 204, and 266 having desired shape, form, and angle to provide the desired dispersion of light. In Step 404, a plurality of light emitting elements 112 and 130 are supported and connected on a substrate 108 and 258. Step 404 also comprises connecting the light emitting elements 112 and 130 to the necessary electrical connectors 128 and connecting those electrical connectors 128 to the base 106. Step 404 further comprises orienting the plurality of light emitting elements 112 and 130 to provide the desired dispersion of light. In step 406, the light emitting elements 112 and 130 are energized by supplying electricity, either DC or AC to the plurality of light emitting elements 112 and 130.

In step 408, the light emitted from the light emitting elements 112 and 130 is tuned to produce a light of desired dispersion characteristics. This tuning step includes providing an optical tuning element 354 that may also include opaque portions 358, mirrored portions 360, and transparent portions 364. The number and area of these portions 358, 360, and 364 are determinable by the desired amount of light dispersion to be provided by the present light bulb. In step 410, other tuning techniques in addition to those originally selected in step 408 are employed.

The present invention also provides preparation a method 450 for manufacturing a light bulb having light generating sources. FIG. 9 illustrates a block flow diagram of an exemplary method 450 in accordance with the present light bulb 100, 150, 200, 250, and 350. In step 452, a housing 102, 202, 252, and 352 is formed using materials and techniques herein described. In step 454, a substrate 108 and 258 is formed using materials and techniques herein described. In step 456, electrical connectors 128 are incorporated into the substrate 108 and 258 in regions where the light emitting elements 112 and 130 are to be connected to the substrate 108 and 258. In step 458, light emitting elements 112 and 130 are connected to the electrical connectors 128 and to the substrate 108 and 258. These connections can be made by those methods commonly known in the arts, such as soldering or the like.

In step 460, the substrate 108 and 258 is mounted to the housing 102, 202, 252, and 352. This step can include mounting a support 110 if one is used, or mounting the substrate 108 and 258 to the housing 102, 202, 252, and 352, or both. In step 462, the electrical connectors 128 are connected to the base 106 and the substrate 108 and 258. When an semiconductor rectifier 109 is used, then the electrical connectors 128 are connected to the semiconductor rectifier 109 which is then connected to the substrate 108 and 258. If other electrical circuitry is employed with the present light bulb, then it is connected to the electrical connectors 128 in order to provide the correct circuitry desired.

In step 464, the light emitting elements 112 and 130 and the optical opening is partially or wholly encapsulated by the optical tuning element 354 or end caps 114 and 262. The distance between the optical tuning element 354 and end caps 114 and the optical opening partly depends on whether the light emitting elements 112 and 130 have lenses or not and the desired dispersion to be provided by the light bulb 100, 150, 200, 250, and 350.

Although there has been described what is at present considered to be the preferred embodiments of the present invention, it will be understood that the invention can be embodied in other specific forms without departing from the spirit or essential characteristics thereof. The present embodiments are, therefore, to be considered in all aspects as illustrative and not restrictive. The scope of the invention is indicated by the appended claims rather than the foregoing description.

What is claimed is:

1. An apparatus comprising:

a housing having a portion that is transmissive to radiation within a waveband;

a substrate supported within said housing and having first and second sides, said substrate being transmissive to radiation within said waveband;

circuitry within said housing, said circuitry including first and second elements that are respectively supported on said first and second sides of said substrate and that can each emit radiation within said waveband, radiation emitted by said first element passing through said portion of said housing, and radiation emitted by said second element passing successively through said substrate and said portion of said housing; and structure that facilitates a supply of electrical power to said circuitry within said housing.

2. An apparatus according to claim 1, wherein said circuitry includes a plurality of said first elements disposed on said first side of said substrate, and a plurality of said second elements disposed on said second side of said substrate.

3. An apparatus according to claim 1, wherein said first and second elements are each one of a light emitting diode and a laser diode.

4. An apparatus according to claim 1, wherein said substrate is a circuit board.

5. An apparatus according to claim 1, including reflective structure disposed within said housing, radiation emitted by said second element being reflected by said reflective structure and then passing successively through said substrate and said portion of said housing.

6. An apparatus according to claim 5, wherein said reflective structure is provided on an inner surface portion of said housing.

7. An apparatus according to claim 6, wherein said inner surface portion of said housing has an approximately frustoconical shape.

8. An apparatus according to claim 6, wherein said inner surface portion of said housing has a flared shape.

9. An apparatus according to claim 6, wherein said reflective structure includes a crystalline particulate material provided on said inner surface portion of said housing.

10. An apparatus according to claim 5, including an insert supported within said housing, said reflective structure being provided on a side of said insert facing said substrate.

11. An apparatus according to claim 10, wherein said side of said insert facing said substrate has approximately a semi-hemispherical shape.

12. An apparatus according to claim 10, wherein said reflective structure includes a crystalline particulate material provided on said side of said insert facing said substrate.

13. An apparatus according to claim 1, wherein said structure includes an electrical connector that is supported on said housing, that is electrically coupled to said circuitry, and that facilitates a supply of electrical power from externally of said housing to said circuitry within said housing.

14. An apparatus according to claim 1, wherein said circuitry includes a semiconductor rectifier supported on said substrate.

15. An apparatus comprising:

a housing having a portion that is transmissive to radiation within a waveband;

a substrate supported within said housing and having first and second sides;

reflective structure disposed within said housing;

circuitry disposed within said housing, said circuitry including first and second elements that are respectively supported on said first and second sides of said substrate and that can each emit radiation within said waveband, radiation emitted by said first element traveling in a direction of travel from said first element to said portion of said housing and then passing through said portion of said housing in said direction of travel, and radiation emitted by said second element traveling to said reflective structure, said reflective structure reflecting the radiation from said second element, the reflected radiation thereafter passing through said portion of said housing approximately in said direction of travel; and structure that facilitates a supply of electrical power to said circuitry within said housing;

wherein said substrate is transmissive to radiation within said waveband, and radiation emitted by said second element passes through said substrate.

16. An apparatus according to claim 15, wherein the radiation reflected by said reflective structure passes successively through said substrate and said portion of said housing.

17. An apparatus according to claim 15, wherein said substrate is a circuit board;

wherein the radiation traveling from said first element to said portion of said housing does not pass through said substrate; and wherein the radiation traveling from said second element to said reflective structure does not pass through said substrate.

18. An apparatus according to claim 15, wherein said circuitry includes a plurality of said first elements disposed on said first side of said substrate, and a plurality of said second elements disposed on said second side of said substrate.

19. An apparatus according to claim 15, wherein said first and second elements are each one of a light emitting diode and a laser diode.

20. An apparatus according to claim 15, wherein said reflective structure is provided on an inner surface portion of said housing.

21. An apparatus according to claim 20, wherein said inner surface portion of said housing has an approximately frustoconical shape.

22. An apparatus according to claim 20, wherein said inner surface portion of said housing has a flared shape.

23. An apparatus according to claim 20, wherein said reflective structure includes a crystalline particulate material provided on said inner surface portion of said housing.

24. An apparatus according to claim 15, including an insert supported within said housing, said reflective structure being provided on a side of said insert facing said substrate.

25. An apparatus according to claim 24, wherein said side of said insert facing said substrate has approximately a semi-hemispherical shape.

26. An apparatus according to claim 24, wherein said reflective structure includes a crystalline particulate material provided on said side of said insert facing said substrate.

27. An apparatus according to claim 15, wherein said structure includes an electrical connector that is supported on said housing, that is electrically coupled to said circuitry, and that facilitates a supply of electrical power from externally of said housing to said circuitry within said housing.

28. An apparatus according to claim 15, wherein said circuitry includes a semiconductor rectifier.

29. An apparatus according to claim 15, wherein said substrate has a portion that is disposed between said first and second elements.

30. An apparatus according to claim 15, wherein said radiation from said first element travels in said direction of travel from said first element to and through said portion of said housing; and wherein said radiation from said second element travels from said second element to said reflective structure in a direction different from said direction of travel, and then travels in said direction of travel from said reflective structure to and through said portion of said housing.

31. A method comprising:

emitting radiation within a waveband from each of first and second elements respectively supported on first and second sides of a substrate that is within a housing and transmissive to radiation within said waveband;

causing radiation emitted by said first element to pass through a portion of said housing that is transmissive to radiation within said waveband;

causing radiation emitted by said second element to pass successively through said substrate and said portion of said housing.

32. A method according to claim 31, including selecting as each of said first and second elements one of a light emitting diode and a laser diode.

33. A method according to claim 31, including configuring said substrate as a circuit board.

34. A method according to claim 31, including reflecting radiation emitted by said second element with reflective structure disposed within said housing, the reflected radiation passing successively through said substrate and said portion of said housing.

35. A method according to claim 34, including configuring said reflective structure to include a crystalline particulate material.

36. A method comprising:

emitting radiation within a waveband from each of first and second elements respectively supported on first and second sides of a substrate disposed within a housing that has a portion transmissive to radiation within said waveband;

configuring said substrate to be transmissive to radiation within said waveband;

causing radiation emitted by said first element to travel in a direction of travel from said first element to said portion of said housing and to then pass through said portion of said housing in said direction of travel;

causing radiation emitted by said second element to travel to and be reflected by reflective structure disposed within said housing, the reflected radiation thereafter passing through said portion of said housing approximately in said direction of travel; and causing radiation emitted by said second element to pass through said substrate.

37. A method according to claim 36, including causing the reflected radiation to pass successively through said substrate and said portion of said housing.

38. A method according to claim 36, including:

configuring said substrate as a circuit board;

causing the radiation emitted by said first element to travel from said first element to said portion of said housing along a route that does not pass through said substrate; and causing the radiation emitted by said second element to travel from said second element to said reflective structure along a path does not pass through said substrate.

39. A method according to claim 36, including selecting as each of said first and second elements one of a light emitting diode and a laser diode.

40. A method according to claim 36, including configuring said reflective structure to include a crystalline particulate material.

41. A method according to claim 36, including configuring said substrate to have a portion that is disposed between said first and second elements.

42. A method according to claim 36, including:

causing said radiation from said first element to travel in said direction of travel from said first element to and through said portion of said housing; and causing said radiation from said second element to travel from said second element to said reflective structure in a direction different from said direction of travel, and then to travel in said direction of travel from said reflective structure to and through said portion of said housing.

* * * * *